US011793315B2

(12) United States Patent
Olarte

(10) Patent No.: US 11,793,315 B2
(45) Date of Patent: Oct. 24, 2023

(54) TABLET ARM WITH EXTRUDED HINGE

(71) Applicant: Series International, LLC, Aventura, FL (US)

(72) Inventor: Alvaro Mauricio Olarte, Aventura, FL (US)

(73) Assignee: Series International, LLC, Aventura, FL (US)

( * ) Notice: Subject to any disclaimer, the term of this patent is extended or adjusted under 35 U.S.C. 154(b) by 0 days.

(21) Appl. No.: 17/886,016

(22) Filed: Aug. 11, 2022

(65) Prior Publication Data

US 2023/0047482 A1 Feb. 16, 2023

Related U.S. Application Data

(60) Provisional application No. 63/231,918, filed on Aug. 11, 2021.

(51) Int. Cl.
*A47C 7/70* (2006.01)

(52) U.S. Cl.
CPC ..... *A47C 7/70* (2013.01)

(58) Field of Classification Search
CPC ..... A47C 7/70
See application file for complete search history.

(56) References Cited

U.S. PATENT DOCUMENTS

| | | | | | |
|---|---|---|---|---|---|
| 5,845,964 | A * | 12/1998 | Phoon | A47C 7/70 | 297/411.3 |
| 5,899,526 | A * | 5/1999 | LaPointe | A61G 5/10 | 297/188.2 |
| 6,073,997 | A * | 6/2000 | Koh | A47C 7/70 | 297/173 |
| 6,220,658 | B1 * | 4/2001 | Lukawski | A47C 7/70 | 297/145 |
| 6,224,149 | B1 * | 5/2001 | Gevaert | A47C 7/70 | 297/162 |
| 7,210,735 | B2 * | 5/2007 | Lang | A61G 5/10 | 297/162 |
| 7,695,061 | B2 * | 4/2010 | Olarte | A47C 7/70 | 297/162 |
| 8,109,566 | B2 * | 2/2012 | Koh | A47B 83/02 | 297/145 |
| 8,813,657 | B2 * | 8/2014 | Winter | B60N 3/002 | 297/145 |
| 9,380,870 | B2 * | 7/2016 | Babick | A47C 7/70 | |
| 10,349,749 | B2 * | 7/2019 | Su | A47C 7/70 | |

* cited by examiner

*Primary Examiner* — Philip F Gabler
(74) *Attorney, Agent, or Firm* — St. Onge Steward Johnston & Reens LLC

(57) ABSTRACT

A tablet mechanism for chairs which allows the tablet to be stored higher and more rearward to enable the tablet to utilize more space available so that the tablet can be larger. The mechanism includes extruded hinge components and allows the tablet to rotate counter clockwise and then down when viewed from the perspective of a seated user and when looking to the right.

8 Claims, 7 Drawing Sheets

TABLET ARM WITH EXTRUDED HINGE

FIELD OF THE INVENTION

The following relates to a tablet arm for chairs which are often used in education settings and lecture halls. More particularly, the following relates to an improved table arm mechanism which is both sturdy and less expensive to manufacture than prior tablet arms.

BACKGROUND OF THE INVENTION

Tablet arms are often made of multiple different injection molded parts. This has some disadvantages in that each part is often relatively complex and has a relatively long molding time as a result. In addition, plastics can be undesirable in certain situations in that they are often less durable than metal.

In addition, the use of injection molded materials also will typically mean that a series of fasteners, bearings or other joints will be needed to be assembled in order to put the mechanism together for the tablet arm and this can result in numerous parts which have to be kept in inventory and can in some cases fail in use and require replacement.

In addition, many prior art tablet arms operate by rotating in a clockwise direction from stored to useable position when viewing from the seated position towards the right. This often means the tablet arm is smaller because there is less space available for storage since the rotation mechanism is often placed in the forward most location on the chair and the tablet rotates from the bottom forward and up and then around backwards towards the user. However, there is often significant space above and behind the chair supports.

SUMMARY OF THE INVENTION

It is an object of the invention to simplify the tablet arm mechanism to use fewer parts and to also utilize metal extrusions, typically aluminum extrusions. It is also an object of the present invention to provide a relatively large tablet arm surface and to enable movement from storage to use positon to include a counter clockwise rotation from the view of the user's right side when the user is sitting in the chair. It is noted that for a left arm mounted chair, when the user faces to the right, the arm would still rotate counter clockwise as it is behind the user. If the user faced left, the left mounted arm would rotate clockwise and the typical prior art mechanism would rotate counter clockwise.

The terms "left" and "right" as used herein are made in reference to the perspective of a user sitting in the chair on which the tablet arm is installed.

These and other objects are achieved by providing a tablet arm system including a support which is connected to a chair, the support positioned upwards with respect to a seat of the chair and forwards with respect to a backrest of the chair, wherein the support is connected to the chair via two armrest support portions such that one end of each armrest support portion is connected to the chair at a different location on the chair and another end of each armrest is connected to the support at a different location on the support. The tablet includes a surface which is connected at one location to a rotatable connection, the tablet movable from a stowed position towards a usable position such that in moving from away from the stowed position, an end of the tablet distal from the one location moves in a counter-clockwise direction about a first axis passing through the support when viewed towards right side of the chair from a user's seated position and wherein the rotatable connection rotates about the first axis and also allows the tablet to rotate about a second axis transverse to the first axis.

In certain aspects the hinge support is extruded and includes a hollow through hole extending in a direction across the seat. In other aspects the direction is parallel the first axis. In certain aspects the tablet pivots about a first axis parallel the direction and about a second axis perpendicular the first axis. In yet other aspects the tablet rotates about the first axis between 120 and 160 degrees between the stowed position to the usable position. In yet other aspects the tablet is in the stowed position an edge of the tablet is parallel to one of the armrest support portions. In other aspects support has a base with two fins extending therefrom at an angle relative to each other which is less than 90 degrees, each fin including a step at an end of the fin which is transverse a mounting surface of the fin, the mounting surface configured to secure to supports. The support has a through hole in the base with a middle rib extending across the through hole wherein a through void is positioned in the middle rib. In certain aspects the support is an extruded metallic material.

Still other objects are achieved by providing a tablet arm extrusion having a base with two fins extending therefrom at an angle relative to each other which is less than 90 degrees, each fin including a step at an end of the fin closer to the base wherein at the end the fin is thicker than at a second end of the fin and wherein a thinner portion of the fin closer to the distal end provides a mounting surface for connection to supports. A through hole is in the base and defines an interior surface and a middle rib extending across the through hole wherein a through void is positioned in the middle rib and the middle rib defining a channel between the middle rib and the interior surface is arc shaped.

In certain aspects at least one hole is in each of the two fins, and the hole arranged along an axis which is transverse an axis of the through void. In other aspects the interior surface is of a first radius larger than a second radius at the middle rib and wherein centers of the first and second radii are in the same location. In still other aspects the channel of the through hole includes rounded ends with a diameter equal to a spacing between the interior surface and the middle rib. In other aspects at least a second channel of the through hole has a different shape than the portion of the through hole. In yet other aspects a surface of the base is rounded between the fins. In yet other aspects the surface has a constant radius. In still other aspects a surface of the base is rounded between the fins on an outer side with respect to the angle. In yet other aspects a second surface of the base is rounded between the fins on an inner side with respect to the angle. In still other aspects the surface and the second surface each have a constant radius. In yet other aspects the constant radius is equal for both the surface and the second surface.

Other objects are achieved by providing a tablet arm system including a support which is connected to a chair. The support is positioned upwards with respect to a seat of the chair and forwards with respect to a backrest of the chair, wherein the support is connected to the chair via an armrest support such that one portion of the armrest support is connected to the chair at first location on the chair and another portion of the armrest support is connected to the support at a second location on the chair. A tablet comprises a surface and is connected at one location to a rotatable connection which is connected to and rotates relative the support. The tablet is movable from a stowed position towards a usable position such that in moving away from the stowed position, an end of the tablet distal from the one location moves in a counter-clockwise direction about a first axis passing through the support when viewing towards a right side of the chair from a seated position when the tablet is mounted on the right side of the chair and wherein the rotatable connection allows rotation about the first axis and also allows the tablet to rotate about a second axis transverse to the first axis.

In certain aspects the support is extruded and includes a hollow through hole extending in a direction across the seat. In other aspects the tablet in the usable position extends across at least 70% of a width of the seat. In further aspects the tablet rotates about the first axis between 120 and 160 degrees between the stowed position to the usable position. In still other aspects, when the tablet is in the stowed position an edge of the tablet is parallel to one of the armrest support portions. In yet other aspects the support comprises a base including two surfaces at an angle relative to each other which is less than 90 degrees, the two surfaces configured to secure in contact with the armrest support. At least two through holes are in the base, a first one of the through holes is aligned with the first axis and a second of the through holes is offset relative to the first axis.

In other aspects the second of the through holes is an arced channel which allows a pin associated with the rotatable element to move therethrough as a second pins positioned in the first one of the through holes rotates about the first axis. In yet other aspects the rotatable connection includes a first pin aligned with the first axis and configured to rotate about the first axis and a second pin aligned with the second axis and connected to the tablet and allowing the tablet to rotate about the second axis, the second pin configured to rotate about the first axis. A stop moves within a channel of the support to inhibit rotation of the rotatable connection about the first axis beyond first and second stop positions. A third pin interacts with the first pin to inhibit the rotatable connection from moving about the first axis relative to the first pin and to inhibit the rotatable connection from translating along the first axis relative to the first pin.

Other objects are achieved by providing a tablet arm hinge mechanism comprising a support portion including at least two through holes and a first pin configured to rotate about a first axis within a first one of the two through holes. A rotatable connector is secured to the first pin and configured to rotate with the first pin about the first axis. A tablet is configured to attach to the rotatable connector at a connection and the tablet configured to rotate relative to the rotatable connector about a second axis, the second axis transverse the first axis and the connection spaced relative the first axis and configured to rotate about the first axis.

In certain aspects a second pin is aligned with the second axis and connected to the tablet and allowing the tablet to rotate about the second axis, the second pin configured to rotate about the first axis. A stop is configured to move within one of the two through holes which is a channel of the support, the stop configured to inhibit rotation of the rotatable connector about the first axis beyond first and second stop positions. A third pin interacts with the first pin to inhibit the rotatable connector from moving about the first axis relative to the first pin and to inhibit the rotatable connection from translating along the first axis relative to the first pin. In other aspects a center of the first pin is spaced from a center of the stop at a distance and a spacing of the center of the first pin to a position of the second axis measured perpendicular to the first axis is at least twice the distance. In yet other aspects a fourth pin connects the rotatable connector to the tablet, the fourth pin aligned with the second axis. In still other aspects, the tablet is movable from a stowed position towards a usable position such that in moving away from the stowed position, an end of the tablet distal from rotatable connector moves in a counter-clockwise direction about the first axis passing through the support when viewing towards a right side of the chair from a seated position when the tablet is mounted on the right side of the chair. In further aspects at least one bushing is positioned between the rotatable connector and the support portion, the support portion and the bushing made of different materials. In other aspects, the bushing is polymeric and the support portion is metallic. In still other aspects the support portion includes at least one threaded hole and an outer surface of a shape matched to fit on a lower and/or interior side of an armrest of a chair. In still other aspects an outer surface of the support portion is rounded at a constant radius and fits in a cooperatively shaped section of an armrest of a chair.

Other objects are achieved by providing a tablet arm system including a support portion comprising a first hole defining a first rotation axis and a second hole defining a radially spaced channel spaced radially from the first rotation axis, said support connected to a chair. A tablet includes a surface and the tablet is connected at one location to a rotatable element, the rotatable element comprising a pin which is positioned in the first through hole and is configured to allow the rotatable element to rotate about the first rotation axis, the rotatable element further comprising a second pin which is positioned in the second hole and spaced relative the pin, the pin configured to move along the channel as the pin rotates about the first axis. A third pin is connected to the rotatable element and defining a second rotation axis transverse to the first rotation axis, the third pin further connected to the tablet to allow the tablet to rotate about the second rotation axis.

In certain aspects an armrest is connected to the chair, the armrest including a concave curved surface. An outer surface of the support portion is a convex curved surface arranged to fit in the concave curved surface. At least one fastener passes through the armrest and into the support portion to secure the support portion to the chair. In other aspects at least one bushing is arranged between the rotatable element and the support portion. The bushing is made of a material different than the support portion.

Other objects of the invention and its particular features and advantages will become more apparent from consideration of the following drawings and accompanying detailed description.

DETAILED DESCRIPTION OF THE INVENTION

Figure 2:
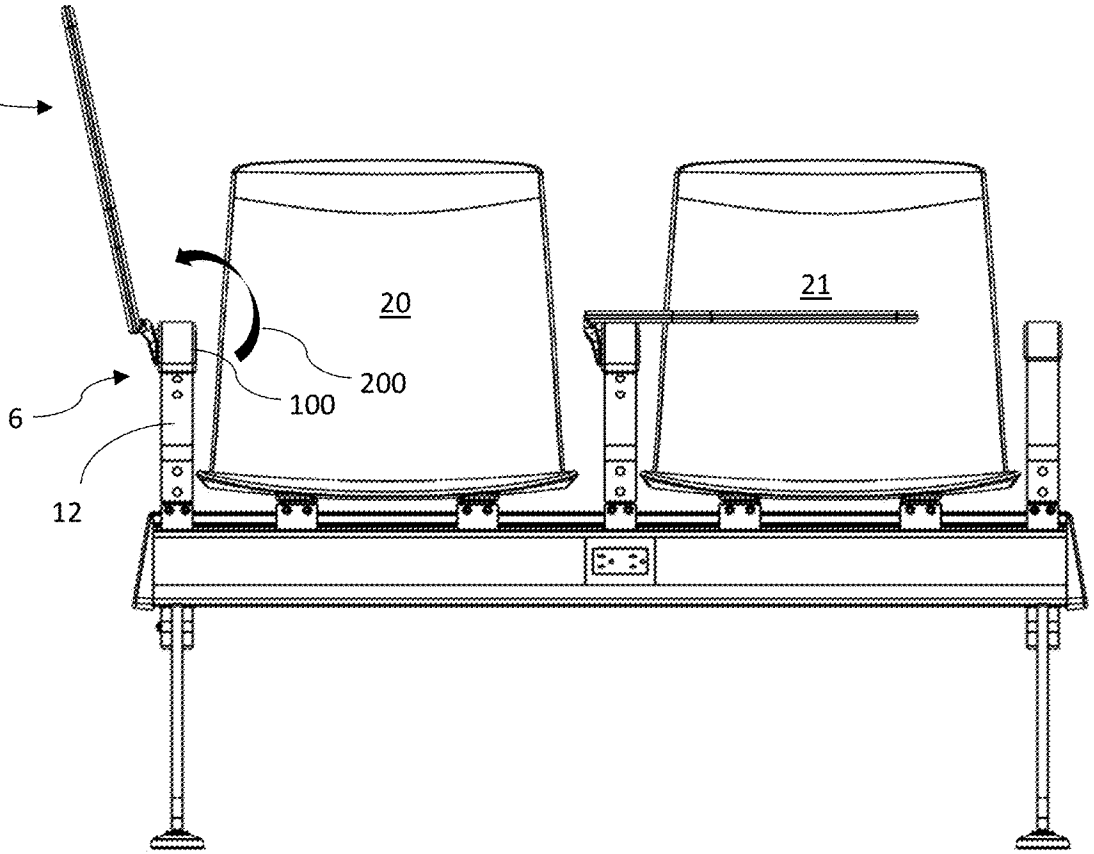
FIG. 2 is a front view of FIG. 1.

Referring now to the drawings, wherein like reference numerals designate corresponding structure throughout the views. The following examples are presented to further illustrate and explain the present invention and should not be taken as limiting in any regard.

Figure 1:
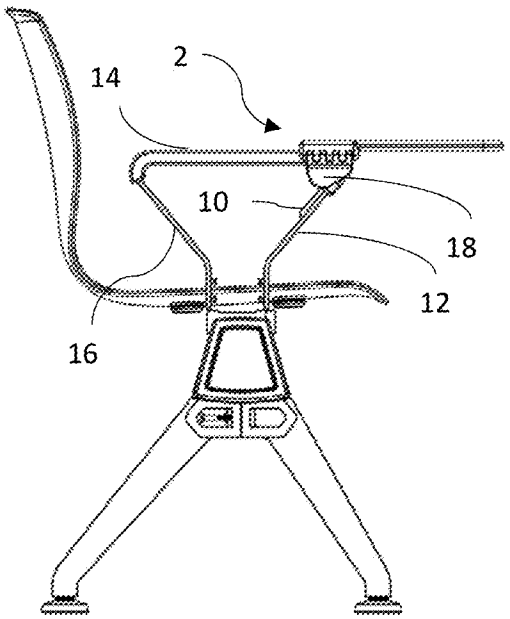
FIG. 1 is side view of a chair system according to the present invention.
Figure 8:
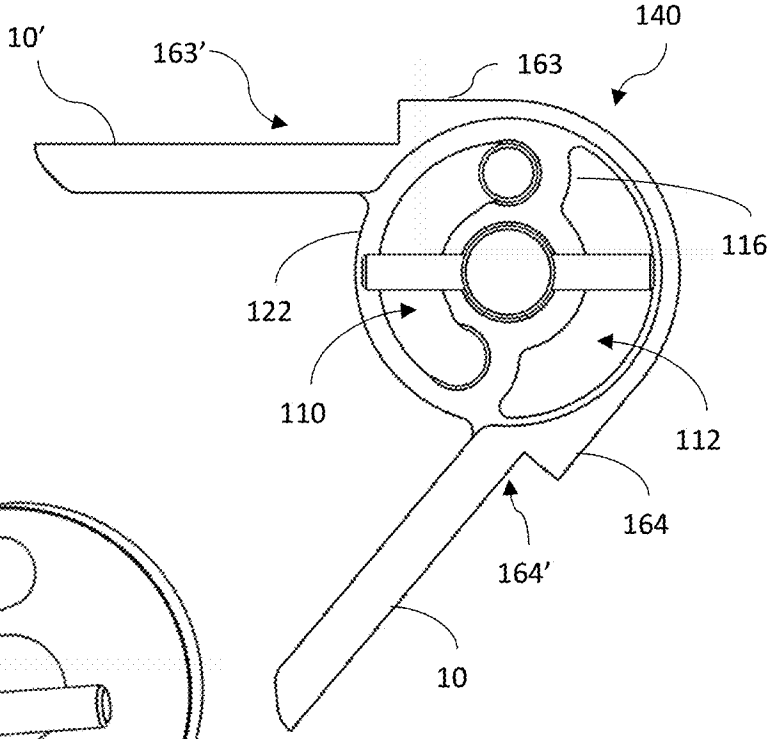
FIG. 8 is a side view of FIG. 6.
Figure 6:
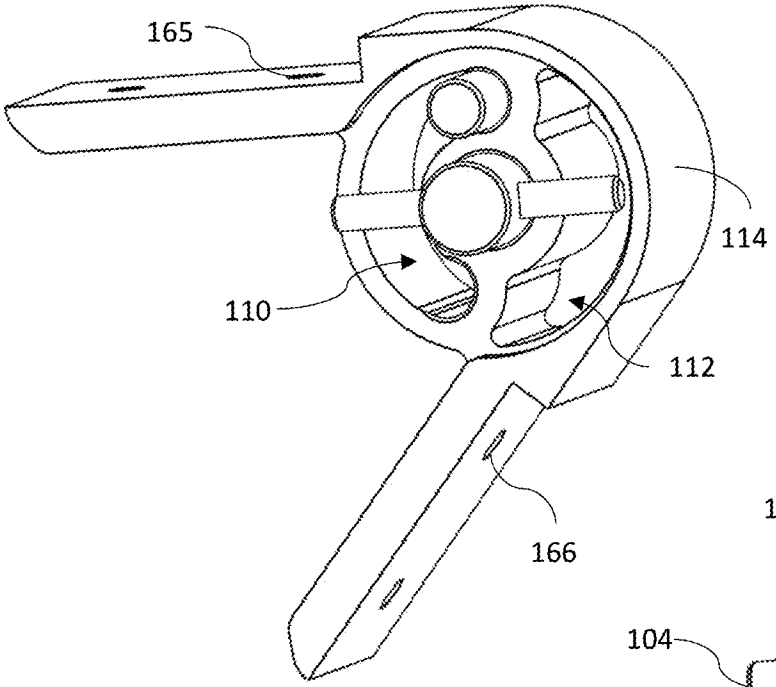
Figure 12:
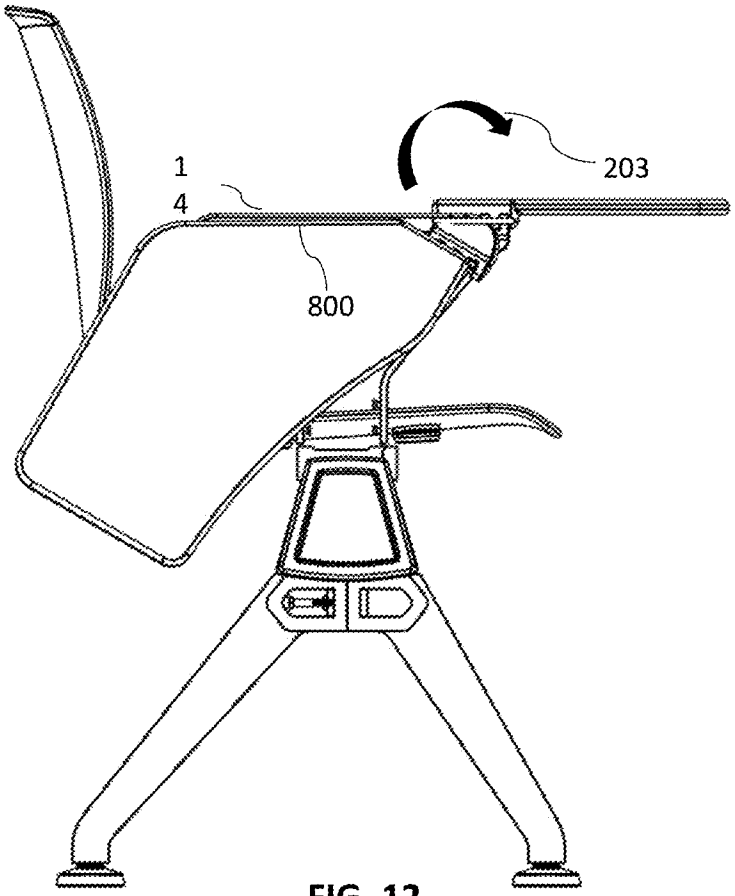
FIGS. 11-12 are side views of the chair according to FIG. 1, showing operation of the tablet arm.

Referring to FIGS. 1 and 2, the chair includes the tablet arm assembly 2 with bracket assembly 6. This bracket assembly includes the tablet connection piece 18 which is connected to the extruded hinge piece (FIGS. 6, 8). Arm supports 12/16 are connected to tabs 10/10' and rotation element 100 rotates within the extruded hinge piece to allow the tablet 80 to pivot 200, 201 into the stored position. As shown in FIG. 12, to go from the stored towards the user position, the tablet rotates in the direction marked by arrow 203. This is clockwise from the view shown, but is understood that when the user is seated and looks to the right, this direction would be counter-clockwise. Although the tablet assembly 2 is shown on the right side of the chair (relative to the view of the user, it is understood that the assembly could be placed on the left side as well and that this would change the direction of rotation 200 to be in the opposite direction so that this direction remains outwards. Armrest cover 14 is shown connected to the upper side 160 of the arm 16.

Figure 11:
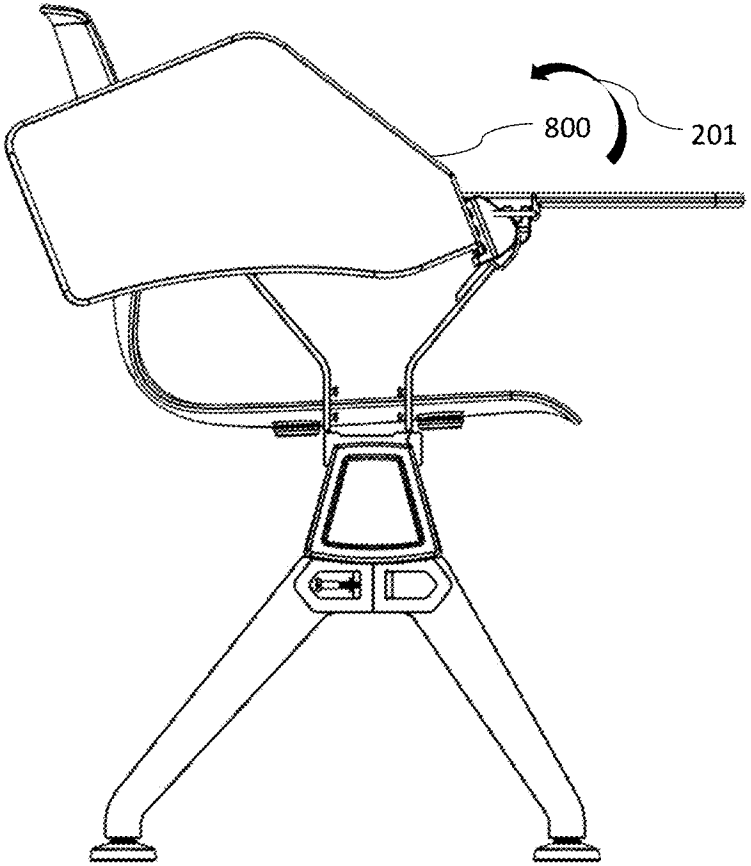
Figure 14:
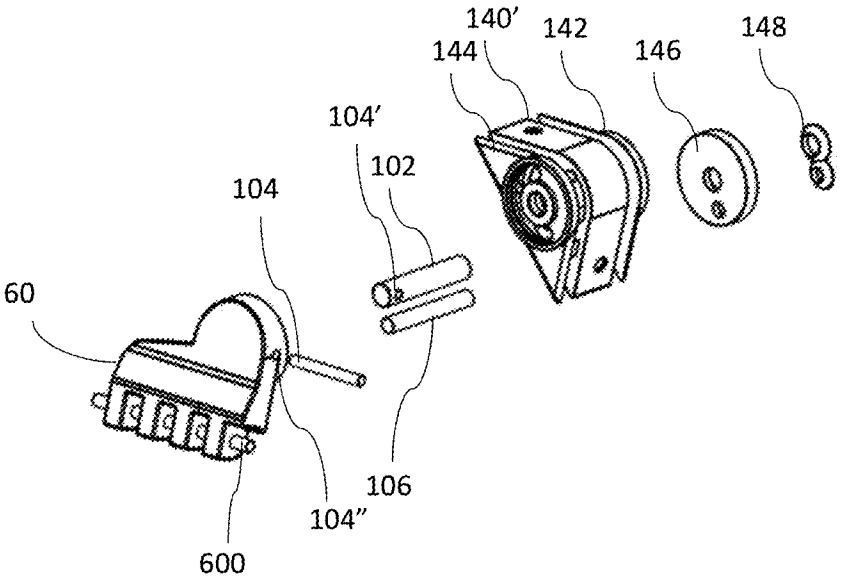
FIG. 14 is an exploded view of the tablet arm mechanism of FIG. 13.
Figure 13:
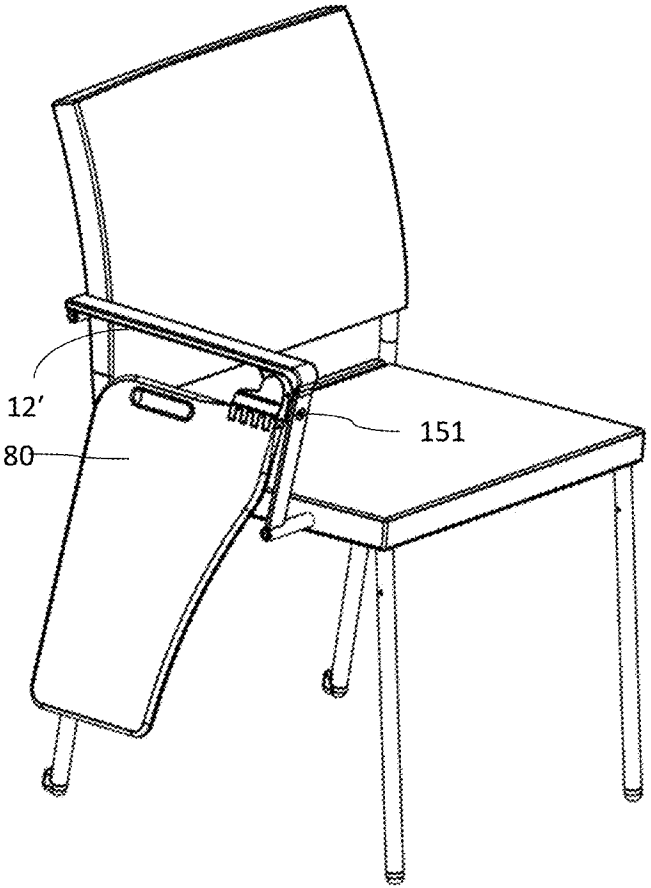
FIG. 13 is a perspective chair with a tablet arm according to the present invention.
Figure 17:
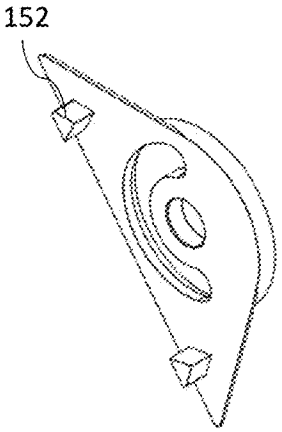
FIG. 17 is a perspective view of FIG. 15.
Figure 16:
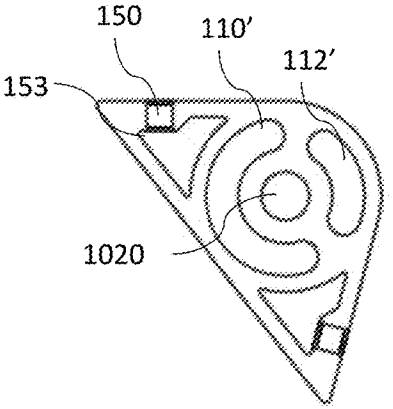
FIG. 16 is a side view of another component of the mechanism of FIG. 14.
Figure 15:
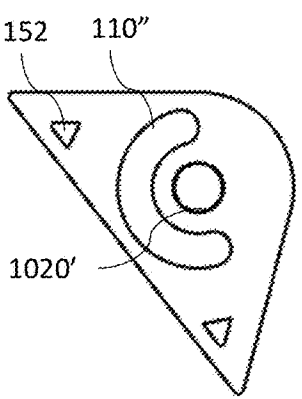
FIG. 15 is a side view of a component of the mechanism of FIG. 14.
Figure 19:
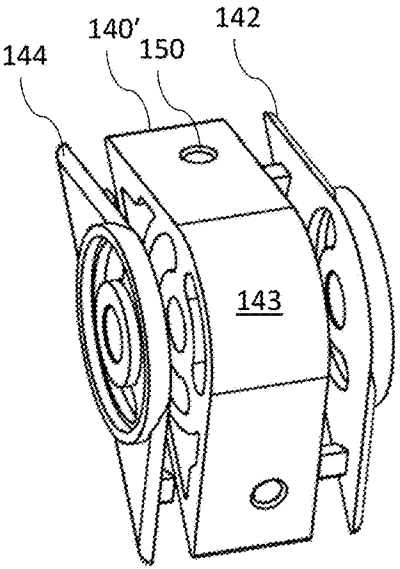
FIG. 19 is an exploded view of certain components of the mechanism in FIG. 14.
Figure 18:
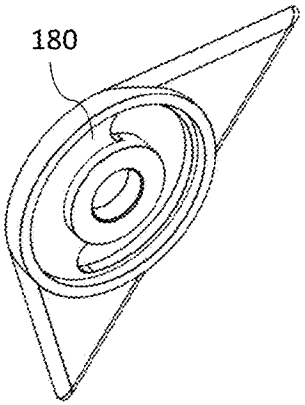
FIG. 18 is a rear perspective view of FIG. 15.

Chair 20 shows the first step of articulating the tablet arm whereas chair 21 shows the tablet arm in the use position. In order to articulate the tablet arm, the first step is to rotate the tablet generally upwards and outwards 200. Next, the tablet arm is rotated counterclockwise 201 (FIGS. 11-12) when viewed from the right side of the chair. As can be seen, when in the stored position (FIG. 12), edge 800 and armrest 14 (or arm support 160) are parallel.

Figures 3, 4, 5:
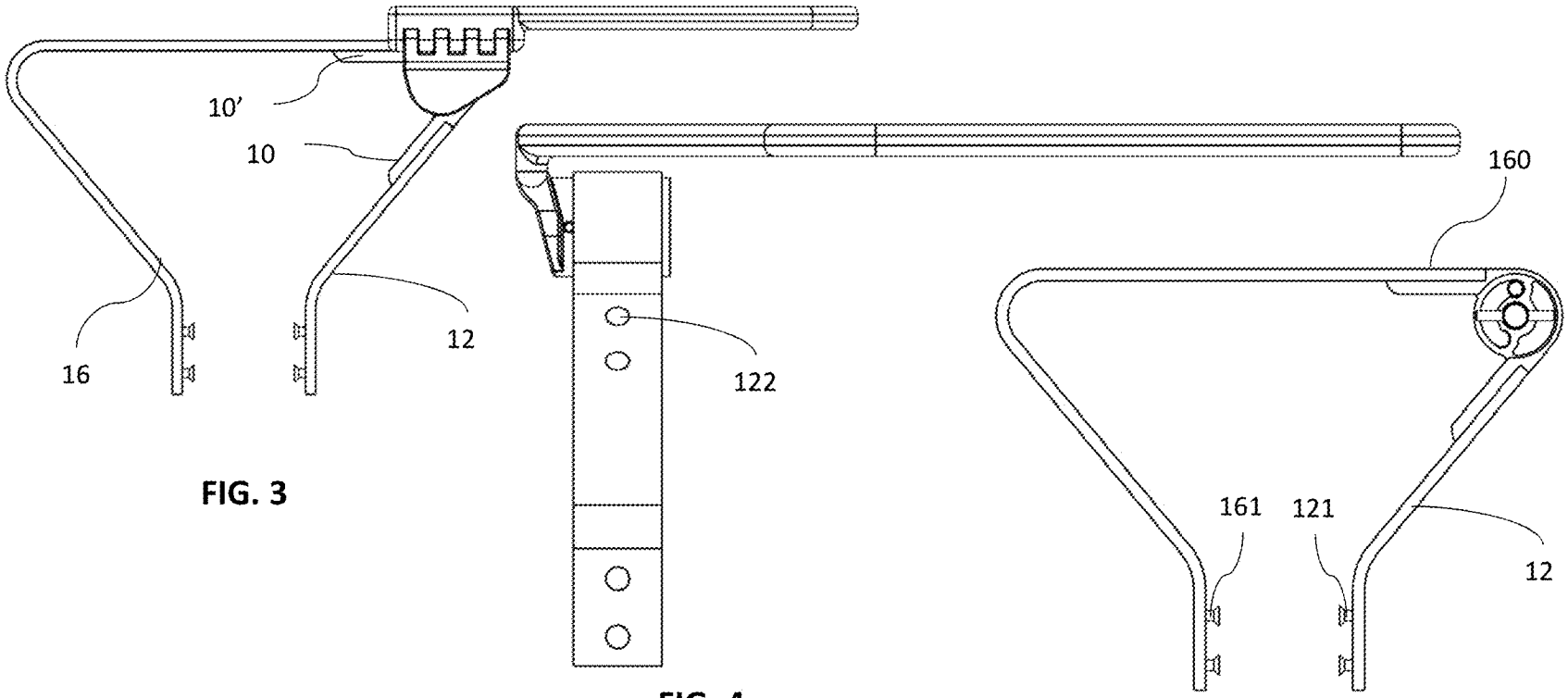
FIG. 3 is a side view of part of FIG. 1.
FIG. 4 is a front view of FIG. 3.
FIG. 5 is a side view of FIG. 3 with certain parts removed.

FIG. 3 shows the tablet arm assembly 2 with armrest cover 14 removed. As can be seen, armrest piece 16 includes a bend away and then a sharper bend towards the hinge 6. Armrest piece 16 is connected to tab 10' of the extruded hinge piece at the upper portion 160 and armrest piece 12 includes a bends towards the hinge 6 and connection to tab 10. The connection is by riveting 122. The lower portions of the armrest pieces 12/16 are also secured to the support structure by riveting 161/121. FIG. 5 shows the tablet arm 80 and hinge part 60 removed.

Figure 7:
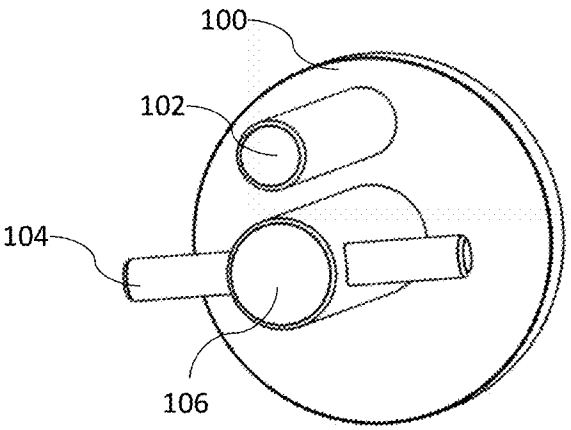
FIGS. 6 and 7 are perspective views of components of the chair of FIG. 1.
Figure 9:
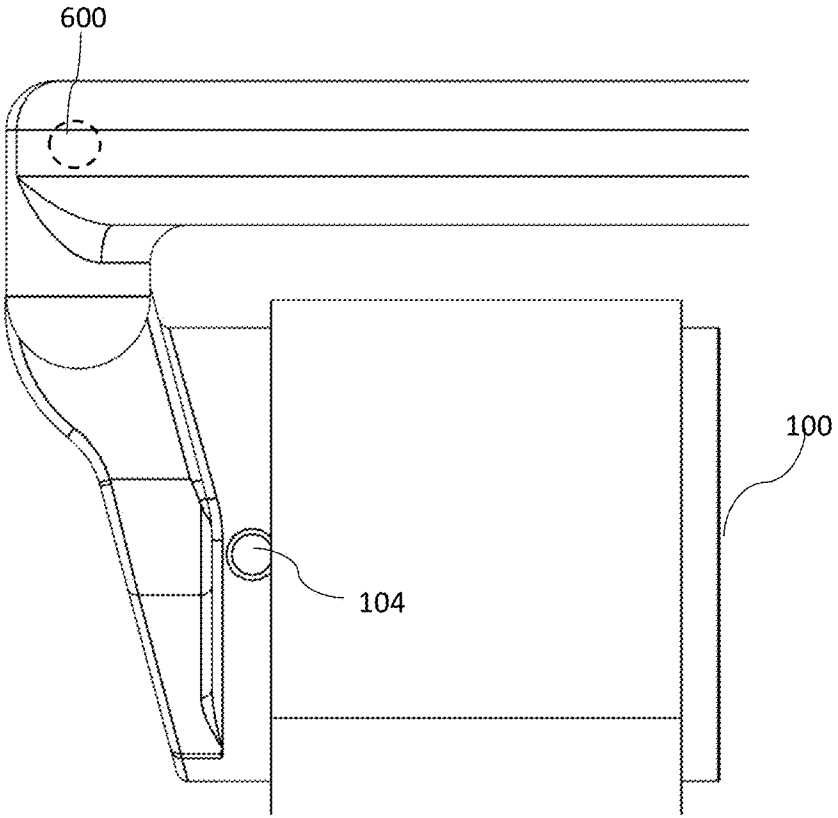
FIG. 9 is a front detail view of FIG. 4.

As shown in FIGS. 6-8, the extruded hinge part includes tabs 10/10' for securing to the arm pieces 16/12 in cutouts 163'/164' or steps which are at the end of the fin closer to the base. These cutouts allow surfaces 164/163 to align with the respective portions of the armrest pieces 12/16 in that the cutouts create thinner portions of the fin. In certain embodiments, the thickness of the fin is equal to the depth of the step or these dimensions are within 15% of each other, more particularly, within 10% of each other. Front curved surface is also provided to have a smooth projecting element to avoid injuring passersby and persons walking in aisles. The tabs 10/10' are also provided with holes 165/166 to allow for securing rivets 122. The channels 112 and 110 are provided to allow pin 102 and in certain cases a second pin (not shown) to rotate in the channel as the tablet arm moves through the counter clockwise rotation 201. Rotation element 100 is shown generally in a disc shape with pins 102/106 extending therefrom. These pins 102/106 generally extend in a direction across the seat and pin 104 is perpendicular to these pins and passes through a hole in pin 106. As can be seen in FIG. 9, pin 104 connects the hinge part 60 to the extruded part via the rotating element 100 to secure the tablet 80 to the chair. The outer surface 114 of the extruded piece is rounded with a constant radius which is preferably centered in the hole in the middle rib 116 which receives pin 106. The same holds true for inner rib 122 which is located within the acute angle (i.e. less than 90 degrees). The acute angle is created by fins 10/10'. As can be seen, the middle rib 116 extends across the opening of the base from which fins 10' and 10 extend from. This creates two channels 112/110. Channel 110 is radial in that pin 102 can move through this channel and the rounded end stops have a diameter equal to the spacing between the middle rib 116 and the interior surface of the opening of the extruded piece. In certain embodiments pin 102 is shorter than pin 106 and both pins 102/106 are longer than the thickness of the base (i.e. measured from left to right of the chair or along the axis of the pins 102/106). In this manner part of pin 102 extends relative the base in order to insert into opening 102' of the hinge part 60 and the pin 106 also inserts into opening 106' while allowing pin 104 and opening 104' to align to allow the hinge part 60 to secure to the extruded part via the rotating part (FIG. 7).

In manufacturing, the extruded part can be easily and efficiently manufactured from a longer extrusion which is drilled 165/166 and then cut to length through simple, fast and repeatable machining operations. The tabs 10'/10 allow arm pieces of different shapes to be bent and connected in order to change the look or dimension or connection points of the armrest and thus provides increased flexibility in the design of chairs with tablet arms.

Figure 10:
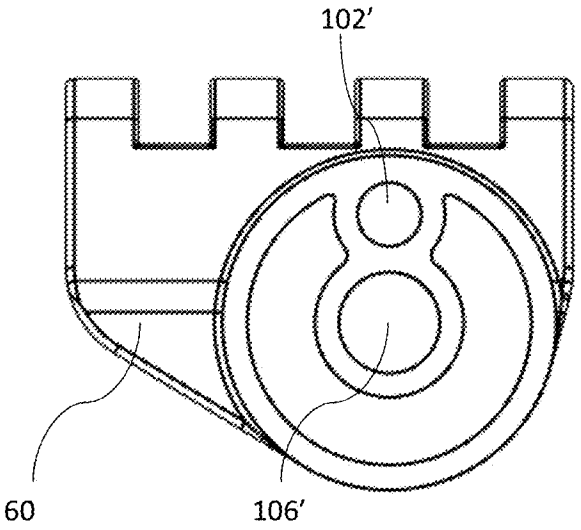
FIG. 10 is a side view of a component of the chair of FIG. 1 (viewed from the left side).

As shown in FIG. 9, hinge part 60 includes holes which allow pin 600 to connect the hinge part 60 to the tablet arm 80. This pin 600 also allows the pivoting upwards and outwards action 200 which is the first part of the movement from use to stored position. The inner side of disc 100 can also be seen and this disc will rotate to allow movement 201 of the tablet arm to/from the stored position. The left side view of the hinge par 60 is shown in FIG. 10 and includes voids 106' and 102' to receive the respective pins 106/102. As shown, the voids 106'/102' extend only partially into but not all the way through the hinge part 60. In preferred embodiments, the hinge part 60 is made of an injection molded plastic. As can be seen pin 104 connects and holds the pins 102/106 in their respective voids and keeps the hinge part 60 assembled to the disc 100 and the overall tablet arm assembly 6.

FIGS. 13-19 shows a different seat and arm assembly variant, but similar functions and structure is provided for the operation of the mechanism. In this case, the arm is a single piece for a majority of it, particularly, a single piece armrest support 12' which connects to the support portion 140' at the two threaded holes 150 with fasteners 151. In particular. The armrest is made from a bent flat piece of metal that has a curved concave surface on the interior of the arm which is matched to the curved exterior (convex) surface 143 of the support portion 140'. The support portion is provided with bushings 144/142 on either side thereof, the bushings meet the rotatable connector 60 on one side and the backing support 146 on the other side. As shown, a channel 180 is removed in the bushing to reduce the total surface area of contact in order to reduce friction. In preferred embodiments, the bushings 144/142, the backing support 146 and the rotatable connector 60 are made of a plastic/polymeric material. For example, a nylon or a glass/fiber reinforced nylon. This use of dissimilar materials provides adequate support, wear properties and adequate reduction in friction to allow for the tablet to be moved between use and stored positions. The bushings include a center hole 1020' and a curved slot 110" which receive the pin 102 and stop 106 respectively. The pin also inserts into hole 1020 in the support portion with the stop 106 inserting into and moving within the curved slot 110' in the support portion. The pin 102 rotates within the hole 1020 to allow the rotating support 60 to move the tablet from the downward facing position shown in FIG. 13 to an upward position such as what is shown in FIG. 2.

Protrusions 152 on the bushing fit into the like shaped portion 153 of the opening in the support portion. The backing support 146 has two holes to receive pin 102 and stop 106 therein. An angled washer 148 secures to the pin 102 and stop 106 and rests in a cooperatively shaped void in the backing support 146. The washer 148 is preferably press fit, welded or otherwise secured to the pin 102 and preferably also the stop 106. On the other side of the pivot mechanism, the pin 104 inserts into hole 104" in the rotating support 60 and in hole 104' in the pin 102. The result is that the rotating support 60 is fixed to the pin such that the pin and rotating support 60 rotate together and so that the rotating support 60 does not translate away from the pin 102. The washer 148 keeps the other side of the pin 102 in position, thereby creating a complete assembly/connection.

Although the tablet arm assembly is shown connected to a particular variant of a beam mounted seat or to a moveable seat, it is understood that the extruded part can be connected to a variety of arm designs and used in a number differently designed arm pieces 12/16.

The tablet as shown is much wider than most conventional tablets, particularly, in the useable position, the tablet extends across a majority of the seat width, preferably more than 60%, more than 70% or even more than 75% of the width. This is in part due to the ability to have the tablet end rotate above the pivot and then down such that the tablet is stored in a more rearward area. Conventional tablet arm mechanisms store the tablet in a more forward and downward position as the tablet has to come forward in front of the user with the end travelling out in front of the front legs. With the mechanism disclosed herein, the end of the tablet moves upwards first and not into the aisle space. The inventive configuration also makes it easier for people to move in and out of the seats in that the tablets can be rotated stored up and away to allow for aisle space rather than needing to protrude more into the aisle first before the aisle can become clear for passage.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A tablet arm system comprising:

a support which is connected to a chair, the support positioned upwards with respect to a seat of the chair and forwards with respect to a backrest of the chair, wherein the support is connected to the chair via an armrest support such that one portion of the armrest support is connected to the chair at first location on the chair and another portion of the armrest support is connected to the support at a second location on the chair;

a tablet comprising a surface and the tablet is connected at one location to a rotatable connection which is connected to and rotates relative the support, the tablet is movable from a stowed position towards a usable position such that in moving away from the stowed position, an end of the tablet distal from the one location moves in a counter-clockwise direction about a first axis passing through the support when viewing towards a right side of the chair from a seated position when the tablet is mounted on the right side of the chair and wherein the rotatable connection allows rotation about the first axis and also allows the tablet to rotate about a second axis transverse to the first axis;

wherein the support comprises a base including a first surface and a second surface at an angle relative to each other which is less than 90 degrees, the two surfaces configured to secure in contact with the armrest support with at least two support portion holes; and wherein the base comprises at least a first and a second through hole, the first one of the through holes aligned with the first axis and a second of the through holes is offset relative to the first axis.

2. The system of claim 1 wherein the support is extruded and includes a hollow through hole extending in a direction across the seat.

3. The system of claim 1 wherein the tablet in the usable position extends across at least 70% of a width of the seat.

4. The system of claim 1 wherein the tablet rotates about the first axis between 120 and 160 degrees between the stowed position to the usable position.

5. The system of claim 1 wherein when the tablet is in the stowed position an edge of the tablet is parallel to one of the armrest support portions.

6. The system of claim 1 wherein the second of the through holes is an arced channel which allows a pin associated with the rotatable connection to move therethrough as a second pin positioned in the first one of the through holes rotates about the first axis.

7. A rotatable connection comprising:

a support which is connected to a chair, the support positioned upwards with respect to a seat of the chair and forwards with respect to a backrest of the chair, wherein the support is connected to the chair via an armrest support such that one portion of the armrest support is connected to the chair at first location on the chair and another portion of the armrest support is connected to the support at a second location on the chair;

a tablet comprising a surface and the tablet is connected at one location to a rotatable connection which is connected to and rotates relative the support, the tablet is movable from a stowed position towards a usable position such that in moving away from the stowed position, an end of the tablet distal from the one location moves in a counter-clockwise direction about a first axis passing through the support when viewing towards a right side of the chair from a seated position when the tablet is mounted on the right side of the chair and wherein the rotatable connection allows rotation about the first axis and also allows the tablet to rotate about a second axis transverse to the first axis;

a first pin aligned with the first axis and configured to rotate about the first axis;

a second pin aligned with the second axis and connected to the tablet and allowing the tablet to rotate about the second axis, the second pin configured to rotate about the first axis;

a stop configured to move within a channel of the support to inhibit rotation of the rotatable connection about the first axis beyond first and second stop positions;

a third pin discrete from the stop, and transverse to the first axis the third pin which interacts with the first pin to inhibit the rotatable connection from moving about the first axis relative to the first pin and to inhibit the rotatable connection from translating along the first axis relative to the first pin, the third pin with synchronous rotation to the tablet.

8. The connection of claim 7 wherein the third pin being insertable and removable relative to the first pin.

* * * * *